United States Patent [19]

Devienne

[11] Patent Number: 4,861,987

[45] Date of Patent: Aug. 29, 1989

[54] PROCESS FOR THE DETECTION OF A CHEMICAL SUBSTANCE OF KNOWN MASS M

[76] Inventor: Fernand M. Devienne, 117 La Croisette, 06400 Cannes, France

[21] Appl. No.: 263,877

[22] Filed: Oct. 28, 1988

[30] Foreign Application Priority Data

Nov. 3, 1987 [FR] France ..... 87 15217

[51] Int. Cl.[4] ..... H01J 49/00

[52] U.S. Cl. ..... 250/282; 250/281; 250/288

[58] Field of Search ..... 250/282, 281, 288, 298, 250/294, 296

[56] References Cited

U.S. PATENT DOCUMENTS

| | | | |
|---|---|---|---|
| 3,916,188 | 10/1975 | Devienne | 250/283 |
| 4,472,631 | 9/1984 | Enke et al. | 250/281 |
| 4,536,652 | 8/1985 | Cooks et al. | 250/282 |
| 4,588,889 | 5/1986 | Naito | 250/295 |

FOREIGN PATENT DOCUMENTS

| | | | |
|---|---|---|---|
| 2215874 | 4/1974 | France . | |
| 0093544 | 5/1986 | Japan | 250/281 |
| WO83/04187 | 5/1983 | PCT Int'l Appl. . | |

*Primary Examiner*—Carolyn E. Fields
*Assistant Examiner*—John A. Miller
*Attorney, Agent, or Firm*—Kerkam, Stowell, Kondracki & Clarke

[57] ABSTRACT

Process for the detection of a chemical substance of known mass M with the aid of an apparatus incorporating an ion source (1) producing ions of the substance of mass M from a gaseous atmosphere to be analyzed; a dissociation box (3) in which the ions of the substance of mass M dissociate into fragments of known masses $m_1$, $m_2 \ldots m_p$, characteristic of the substance of mass M to be identified; an electrostatic analyzer (4) filtering the ions of energy W; a magnetic analyzer (5) operating with an induction $B_o$ in its air gap, characterized in that: the value $B_o$ is fixed by choosing for V and W values $V_o$, $W_o$ such that an atom of mass $M_o$ traverses the apparatus, which is carried out in known manner, on satisfying the equations $$B_o \simeq \frac{144\sqrt{eV_oM_o}}{R} \text{ and } W_o = eV_o$$

in which R is the radius of curvature of the trajectory of the ion in the magnetic analyzer; for the investigating the presence in the atmosphere to be analyzed of the known substance of mass M able to dissociate into known fragments of masses $m_1=x_1M$, $m_2=x_2M \ldots m_p=x_pM$ the apparatus is calibrated for the specific investigation of the mass M by giving $V_o$ and $W_o$ new values V' and W' such that $V'M=V_oM_o$ and $W'-eV'$, followed by the sequential investigation of the different fragments $m_p$ by effecting on each occasion $V_p=(V'/x^2_p)$ and $W_p=(W'/x_p)$ which allows the ion of mass $m_p$ to traverse the complete apparatus and to be revealed by the ion detector; from it is deduced the effective presence of the substance of mass M.

3 Claims, 3 Drawing Sheets

PROCESS FOR THE DETECTION OF A CHEMICAL SUBSTANCE OF KNOWN MASS M

The present invention relates to methods for the detection of chemical substances of known masses $M_i$ with the aid of an ionization, dissociation, filtration and detection apparatus successively making it possible to produce ions of the substances to be detected, their dissociation by impacts on molecules of neutral gas and the investigation of the dissociation fragments of known masses $m_i$ of the substances of masses $M_i$ to be identified.

Such an apparatus for the ionization, dissociation, filtration and detection of the secondary ions formed is described in French Pat. No. 73 02771 filed on Jan. 26, 1973 by the Applicant and published under No. 2 215 874 (U.S. Pat. No. 3,916,188).

This apparatus essentially comprises, placed in a vacuum enclosure and in the indicated order on the trajectory of the ions (cf. FIG. 1):

(a) an ion source 1 producing, from a supply 2 from the atmosphere to be monitored, ions of the substance of mass M and unit charge e under the extraction voltage $V_1$, (b) a dissociation box 3 raised to the extraction voltage $V_2$ and filled with a neutral gas in which the ions of the substance of mass M are dissociated by impact on the molecules of the neutral gas into different fragments of known masses $m_1, m_2 \ldots m_p$, which characterize the substance of mass M to be identified, (c) an electrostatic analyser 4 only permitting the passage of the ions of given energy W, said energy level W being regulatable, (d) a magnetic analyser 5 operating with a magnetic induction $B_o$ in its air gap, the trajectory of the ions within said analyser 5 being curved by the induction $B_o$ in accordance with a circular trajectory of radius R and (e) a detector 6 of the ions which have traversed the preceding apparatus.

According to FR-A-73 02771, said apparatus is used for filtering ions in the following way. The primary ions of mass M are extracted from the source 1 under voltage $V_1$ with respect to the mass. In the dissociation box 3, which is raised to the voltage $V_2$ with respect to the mass, they undergo dissociation by impacts on molecules of the neutral gas contained in said box and produce a certain number of secondary ions of mass $m_i$, which are then filtered by the electrostatic analyser 4, regulated to a filtration energy equal to eV''. The ions of mass m having in this way traversed the electrostatic analyser 4 are then deflected into the magnetic analyser 5 and detected in detector 6.

The theory of the process of using the aforementioned apparatus described in FR-A-73 02771 shows that the ion m which has passed through the aforementioned apparatus is in a mass ratio $M/m = V_1 - VHD\ 2/V'' - V_2$ with the primary ion of mass M which gave rise to it. Therefore this method makes it possible to determine, by analysing fragments of mass m having traversed the apparatus, the presence of a substance of mass M in the atmosphere which it is wished to monitor and with the aid of which the ion source 1 is supplied.

However, in this embodiment of the aforementioned apparatus, the settings of the latter are often complex because, as a function of the envisaged investigation type, it is possible to act on the potentials $V_1$, $V_2$, on the filtration energy cV'' of the electrostatic analyser 4 and on the magnetic field $B_o$ of the magnetic analyser 5 in order that a secondary ion of mass $m_i$ passes through the entire system and is detected in detector 6. Thus, the operations involved are often long and complicated and do not easily make it possible to automate the system with a view to the systematic monitoring of an atmosphere to be permanently controlled.

The Applicant has revealed the possibility of using the apparatus described in FR-A-73 02771 according to another simpler process, specifically in automatic form, with the aid of informatics means and making it possible more particularly to permanently monitor the pollution state of a given atmosphere or the rapid investigation of the presence in the air of undesirable toxic compounds.

The present invention therefore relates to a process for the detection of a chemical substance of known mass M with the aid of an ionization, dissociation, filtration and detection apparatus having in a vacuum enclosure and in the indicated order on the trajectory of the ions:

an ion source producing ions of the substance of mass M and unit charge e under the extraction voltage V from a gaseous atmosphere to be analysed, a dissociation box raised to the potential of the mass M filled with a neutral gas in which the ions of the substance of mass M are dissociated by impacts on the molecules of the neutral gas into different fragments of known masses $m_1, m_2 \ldots m_p$, characteristic of the substance of mass M to be identified, an electrostatic analyser filtering the ions of energy W, said energy level W being regulatable, a magnetic analyser operating with an induction $B_o$ in its air gap, a detector of the ions which have already passed through the aforementioned apparatus, characterized in that:

the first step is to fix the value of the induction $B_o$ in the air gap of the magnetic analyser by choosing for V and W values $V_o$, $W_o$ such that an indissociable atom of mass $M_o$ passes through the entire apparatus and is detected by the ion detector, which is carried out in known manner when the equations $$R_o = \frac{144\sqrt{eV_oM_o}}{R}$$

$$B_o \simeq \frac{144\sqrt{eV_oM_o}}{R} \text{ and } W_o = eV_o$$

in which R is the radius of curvature of the trajectory of the ion in the magnetic analyser are satisfied, to then investigate the presence in the atmosphere to be analysed of the known substance of mass M, which can be dissociated into known fragments of masses $m_1 = x_1M$, $m_2 = x_2M$, . . . $m_p = x_pM$, the apparatus being calibrated for the specific investigation of the mass M by giving to $V_o$ and $W_o$ new values V' and W' such that $V'M\text{-}V_oM_o$ and $W' = eV'$, followed by the sequential investigation of the different fragments $m_p$, whilst forming on each occasion $V_p = (V'/x_p^2)$ and $W_p = (W'/x_p)$, which makes it possible for the ion of mass $m_p$ to pass through the entire apparatus and to be revealed by the ion detector and the effective presence of the substance of mass M in the supply gas of the ion source is deduced by the presence of an adequate number, in practice three or four, of dissociation fragments of mass $m_p$ characteristic of the dissociation of the substance of mass M.

One of the major advantages of the aforementioned process is that it is possible to work, for a series of detections or measurements, with a magnetic analyser operating with an induction $B_o$ in its constant air gap. Therefore, during the different stages of performing the process, there is no need to make difficult settings of the magnetic induction of said analyser in order to obtain the passage of a secondary ion of mass $m_1$. Moreover, another important difference compared with the process of FR-A-73 02471 is that the dissociation box 3 is generally earthed or grounded. Under these conditions, the only two parameters on which it is necesary to act for carrying out the different stages of the process are the voltage V for extracting the ions from the source 1 and the energy W for filtering the ions in the electrostatic analyser 4. However, it is known that the setting of a voltage takes place more easily and with greater accuracy than that of a magnetic field, particularly when operating automatically.

Figure 1:
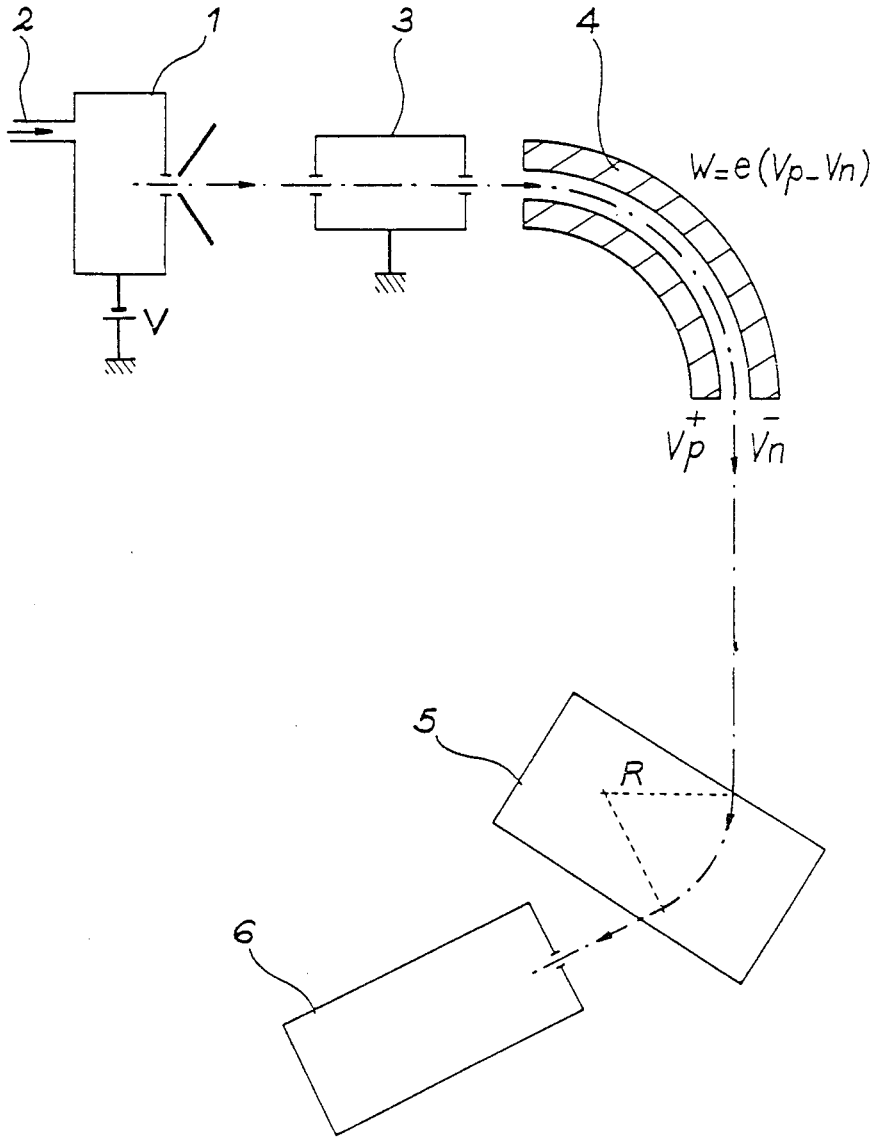
FIG. 1 illustrates a device for the filtration of ions by means of a dissociation box, an electrostatic analyser and a magnetic analyser.

It is pointed out that if $V_p$ and $V_n$ are used for designating the potentials with respect to the mass of the two electrodes of the electrostatic analyser, its filtration energy is $W=e(V_p-V_n)$ for a unit charge ion. By regulating the potentials $V_p$ and $V_n$, it is consequently possible to regulate a given value of the energy of the particles which said analyser allows to pass.

The performance of the detection process according to the invention with the aid of the aforementioned apparatus successively involves a regulating phase followed, for each substance of mass M, by a calibration phase and an investigation phase with respect to said chemical substance of known mass M.

The regulating phase is that during which the value $B_o$ of the induction in the air gap of the magnetic analyser 5 is fixed by choosing for V and W values $V_o$ and $W_o$ such that an indissociable atom of mass $M_o$ can pass through the entire apparatus and can be detected by the ion detector 6. According to the invention, the value of $B_o$ for a series of detections is chosen as a function of the mass M to be detected. Thus, the higher said mass M, the more it is necessary to choose a high value for $B_o$ to ensure that the extraction voltage V' is not too low, which would reduce the sensitivity of the measurements.

In accordance with what has been stated hereinbefore, the indissociable atom of mass $M_o$, which can e.g. be an atom of an inert gas such as xenon, argon or krypton, is extracted from the ion source 1 with energy $eV_o$, because by hypothesis its charge is the unit charge e. In order that it is able to traverse the electrostatic analyser 4, the only condition to be satisfied is consequently that the filtration energy $W_o$ of said analyser is such that $W_o=eV_o$.

Moreover, it is known by spectrometry experts that an ion of mass $M_o$ and energy $eV_o$ traverses a magnetic analyser when the following equation, expressed in coherent units, is satisfied:

$$R_o = \frac{144\sqrt{eV_oM_o}}{R}$$

R being the radius of the circular trajectory of the ion in the magnetic analyser.

Under these conditions, the operation of regulating or setting the apparatus consists of choosing an atom of mass $M_o$ which is known to be indissociable, ionizing it, extracting it under the voltage $V_o$ and regulating the magnetic induction $B_o$ in the magnetic analyser and the filtration energy $W_o$ in the electrostatic analyser 4 in such a way that said ion, which by definition undergoes no dissociation in box 3, traverses the entire system and can be detected by detector 6.

When this has been done, the quantity $B_o$ will be fixed and is kept constant throughout the detection operations of the same series of substances.

The apparatus is then ready to start the systematic investigation of the presence in the atmosphere to be analysed of a known substance of mass M and whereof beforehand are known the dissociation fragments of mass $m_1=x_1M$, $m_2=x_2M$, . . . $m_p=x_pM$.

The detection of a known substance of mass M involves a calibration of the apparatus followed by a sequential investigation of the secondary ions of masses $m_p$ at the exit from the dissociation box 3. In the calibration stage, new values V' and W' are given to $V_o$ and $W_o$ such that $V'M=V_oM$ and $W'=eV'$, which frictionally amounts to making the apparatus "conductive" for an ion having mass M.

The sequential investigation of each of the fragments of known masses $m_p$ and the dissociation characteristics of the ion of mass M then takes place by modifying on each occasion the extraction voltage of the ion source and the filtration energy of the electrostatic analyser in accordance with the equations $V_p=V'/x_p^2$ and $W'_p=W'/x_p$, whereby it will be shown that they are necessary and adequate to enable the secondary ion of mass $m_p$ from the ion M to traverse the entire apparatus and be revealed by detector 6. Thus, the passage of the secondary ion of mass $m_p$ through the apparatus is effective if it successively passes through the electrostatic analyser and the magnetic analyser.

The passage through the electrostatic analyser requires that the energy of said ion is $W_p=(W'/x_p)$ (1). However, the kinetic energy of the ion mass $m_p$ resulting from the dissociation of the ion of mass M extracted from said ion source with the energy $eV_p$ is $eV_p.x_p$ (2), because the kinetic energy supplied by the dissociation fragment of mass $m_p$ is in the ratio of masses $(m_p/M)=x_p$. The formula (2) can be written:

$$ev_p \cdot x_p = e\frac{V'}{x_p^2} \cdot x_p = \frac{eV'}{x_p} = \frac{W'}{x_p}$$

which demonstrates that relation (1) is satisfied.

The passage through the magnetic analyser simply requires, because by definition $B_o$ and R are constant, that $\sqrt{eV_oM_o}$ is constant, i.e. that the product of the energy of the secondary ion investigated by its mass is equal to $eV_oM_o$. It can be written that this product is equal to:

$$eV_p \cdot x_p \cdot m_p = e\frac{V'}{x_p^2} \cdot x_p \cdot m_p = e\frac{V'}{x_p} \cdot m_p = eV'M = eV_oM_o$$

Thus, the sought equality is also proved and calculation shows that on regulating the voltages in such a way that:

$$V_p = \frac{V'}{x_p^2}, \; W' = eV' \text{ and } W_p = \frac{W'}{x_p}$$

the apparatus can be traversed by the secondary ion of mass $m_p$.

In practical terms, as soon as several dissociation fragments of mass $m_p$ characteristic of the decomposition of the known ion of mass M have been detected, it is possible to affirm that the corresponding substance is present in the atmosphere being monitored and with the aid of which the ion source 1 is supplied. The number of dissociaton fragments of mass $m_p$ necessary to be able to affirm with a high degree of probability the effective presence of the sought substance of mass M in the source supply gas is obviously dependent on the magnitude of the mass M of the substance to be detected and its complexity. Thus, in the case of polluting or toxic products present in the air, the sought molecules have well known decomposition diagrams and it is relatively easy to give a judgement as soon as a detection has taken place of the presence of three or four secondary dissociation ions of the primary ions.

The present invention also relates to a process for the detection in the atmosphere of a series of chemical substances of masses $M_i$, each having dissociation fragments of known masses $m_{i1}, m_{i2}, \ldots m_{ip}$, characterized in that said detection is rendered automatic by placing in a memory the different values of the sought masses $M_i$, as well as for each of them, the different masses $M_{i1}, \ldots m_{ip}$ of their possible dissociation fragments and that a sequential investigation is carried out by a computer equipped with a program controlling the different stages of the process, the presence or absence of each of the substances of mass $M_i$.

More specifically, the process of the automatic detection of chemical substances of mass $M_i$ involves, under the control of a computer, several consecutive stages of investigating on each occasion one of the substances of mass $M_p$, each stage of such an investigation involving:

(a) a calibration of the apparatus to define the values $V'_p$ and $W'_p$, such that $V'_pM_p = V_oM_o$ and $W'_p = eV'_p$, (b) a sequential investigation of the dissociation fragments $m_{pq}$ of the ion $M_p$ at the exit from the collision box, the computer controlling for each sought fragment $m_{pq}$ the setting of the magnitudes V and W at the values $V_{pq} = (V'_p/x_{pq}^2$ and $W_{pq} = (W'_p/x_{pq})$, with $x_{pq} = (m_q/M_p)$.

The settings necessary for each investigation sequence of a given substance in the atmosphere to be monitored, according to the inventive process, only requires settings of the extraction voltage V and the filtration energy w of the electrostatic analyser and said two quantities can easily be sequentially controlled with the aid of a computer programmed for this purpose and which operates on the basis of a memory into which has been fed both the different known substances of mass $M_i$ whose possible appearance in the atmosphere is to be monitored and, for each of them, the masses $m_i$ of their main dissociation compounds. The computer software consequently controls the sequential investigations of the substances of mass $M_p$, in a successive manner and for each of them, the investigation of their dissociation fragments of mass $m_q$ by modifying on each occasion the extraction voltage and the filtration energy in accordance with the formulas given hereinbefore.

The possible automation of the process according to the invention is therefore advantageous for the permanent and automatic monitoring of the pollution or toxicity state of the atmosphere.

Figure 2:
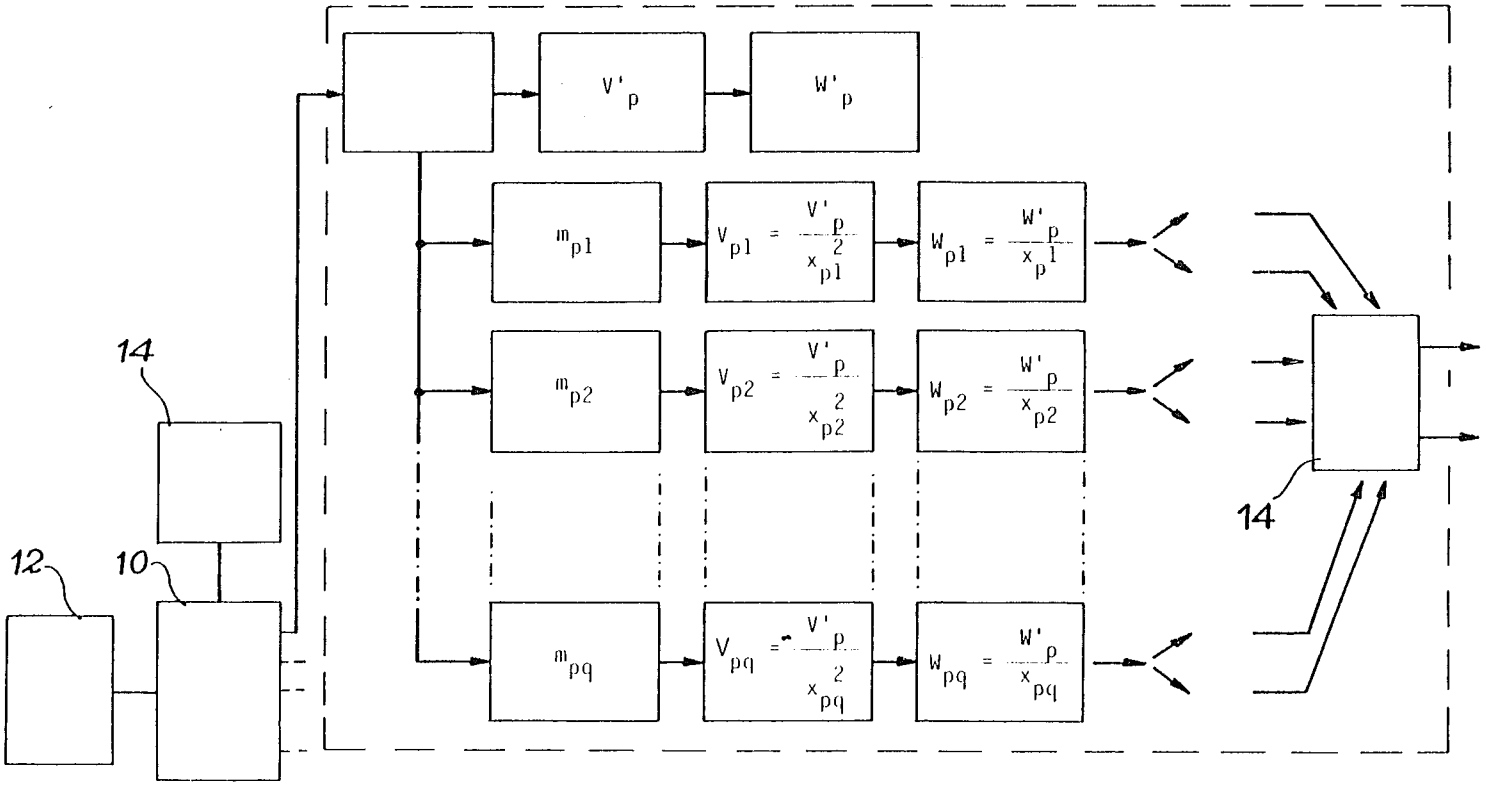
FIG. 2 is a diagram of the investigation sequences of the compound of mass $M_p$.
Figure 3:
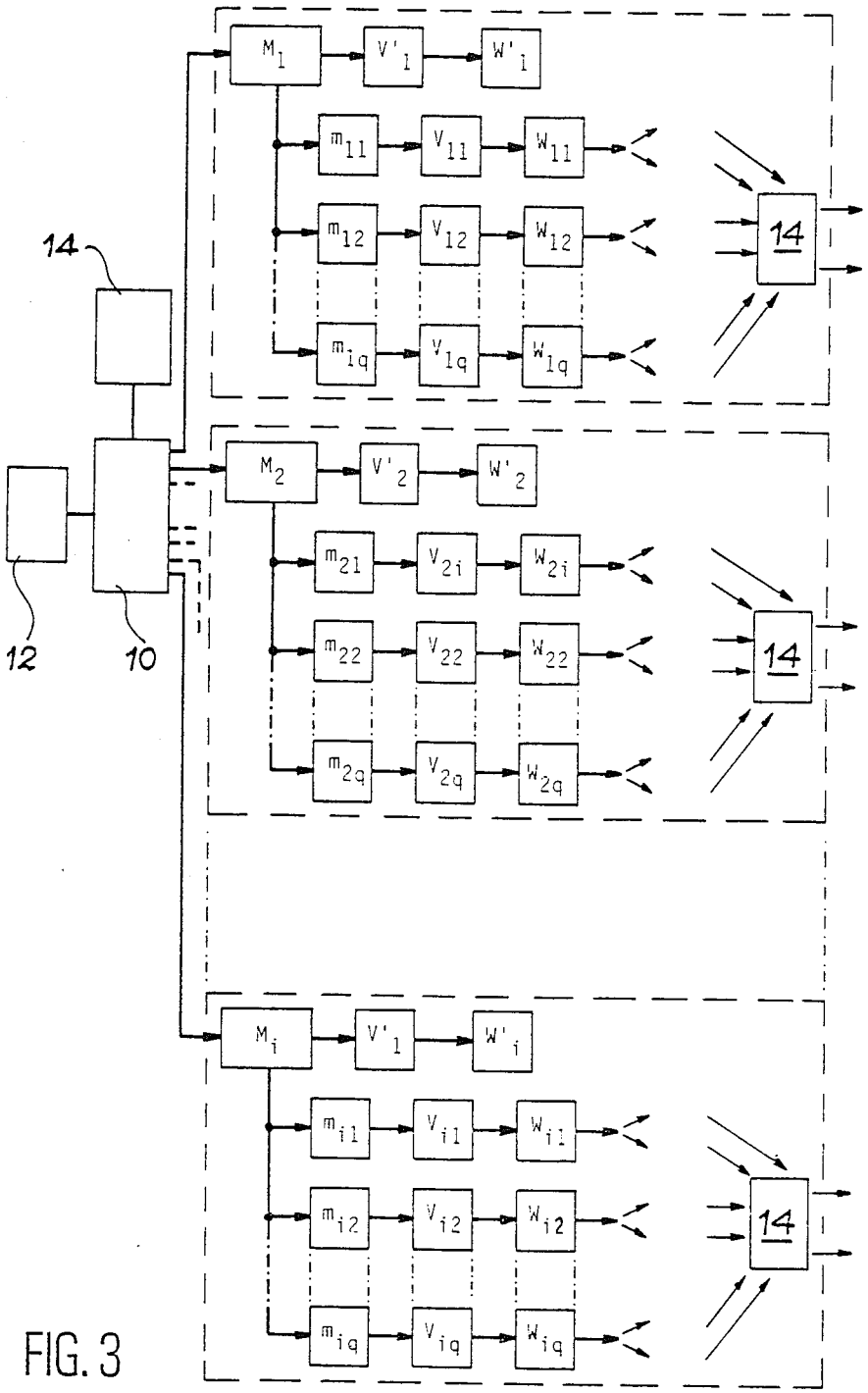
FIG. 3 shows the overall diagrams of the automatic investigation operations in connection with the substance $M_i$.

The invention will be better understood by referring to the following description of a number of examples concerning the performance of the process for the detection of the presence in the atmosphere of a chemical substance of known mass M, said description being given in an illustrative and non-limitative manner with respect to tables 1 and 11 and FIGS. 2 and 3.

The first three following examples deal with the detection in air of known substances, namely nitrogen, carbon monoxide and ethylene of respective molecular masses 28.006 for $N_2$, 27.995 for CO and 28.03 for $C_2H_4$. These three substances were deliberately studied together because they provide an amazing demonstration, despite the very great proximity of their molecular masses, of the effectiveness of the detection process according to the invention by means of which it is possible to separate them without difficulty, whereas said separation would have been virtually impossible even with a very good mass spectrometer. In the three following examples, the magnetic field $B_o$ has a value of 3000 Gauss and the magnetic analyser a radius R=10.5 cm.

EXAMPLE 1

Nitrogen $N_2$ is investigated. The molecular mass of the initial ion M is equal in this case to 28.006 daltons. The presence of $N_2$ ions is indicated by that of the nitrogen N atom of mass m=14.003 daltons. In this example, x=0.5 and the reference extraction voltage V'=1708.6182 V, the extraction voltage for the $N^+$ ion $Vp = (V'/x_p^2)$ is 6834.4729 V and the filtration voltage by the electrostatic analyser proportional to the energy $W_p$ $(W'/x_p)$ is 3417.2364 V.

EXAMPLE 2

This example relates to the detection of carbon monoxide from its dissociation oxygen atom O. The initial mass M of the CO molecule is 27.995 daltons and the mass of the secondary oxygen ion is m=15.995 daltons. The mass ratio is $x_p$=0.5713. The reference extraction voltage is V'=1709.2896 V and the extraction voltage $V_p = V'/x_p^2$=5236.1021 V. Under these conditions, the electrostatic filtration voltage $V'/x_p^2$ of the oxygen atom is equal to 2991.6575 V.

EXAMPLE 3

This example relates to the dissociation of the carbon monoxide CO molecule, indicated on this occasion with the aid of the secondary ion of the carbon atom C of mass m=12 daltons by definition. The reference voltage V' is the same as in example 2. Under these conditions, the ratio of the masses of the carbon compared with the carbon monoxide molecule is $x_p$=0.4286. The extraction voltage of the carbon atom is $V'/x_p^2=9302.8089$ V and the electrostatic filtration voltage is $V'/x_p=3987.6302$ V.

EXAMPLE 4

This relates to the dissociation of the ethylene molecule $C_2H_4$ into $C_2H_3+H$, the secondary ion $C_2H_3$ being used for the identification of the molecule $C_2H_4$. Under these conditions, the mass of the primary ion is $M=28.03$ daltons, the mass of the secondary ion is $m=27.0225$ daltons and the mass ratio is $x=0.9640$. For a reference extraction voltage of $V'=1707.1552$ V, the secondary ion $C_2H_3^+$ is extracted when $V'/x^2=1836.8266$ V and the voltage of the electrostatic analyser is $V'/x=1770.8044$ V.

EXAMPLE 5

This relates to the dissociation of the ethylene molecule $C_2H_4$ into $C_2H_2+H_2$, the secondary ion $C_2H_2$ serving for the identification of the molecule $C_2H_4$. Under these conditions, the mass M of the primary ion is 28.03 daltons, the mass of the secondary ion is $m=26.015$ daltons and the mass ratio is $x=0.9281$. For a reference extraction voltage $V'=1707.1552$, the secondary ion $C_2H_2^+$ is extracted when $V'/x_2=1981.8535$ V and the voltage of the electrostatic analyser is $V'/x=1839.3835$ V.

It has been clearly shown with the aid of the four above examples that the molecules $N_2$, CO and $C_2H_4$ of extremely close molecular masses (approximately 28) are very easily separated by the present apparatus, because they are detected by extraction voltages of their secondary ion m $V=6834.4729$ V, 5236.1021 V, 9302.8089 V, 1836.8266 V and 1981.8535 V. The two latter molecules, which are virtually inseparable even by the most accurate mass spectrometers when the concentration ratio of CO and $C_2H_4$ to the nitrogen in the air is low arc in this case identified and separated with an accuracy and ease which are completely exceptional and with respect to which there can be no doubt.

The following examples 6 to 11 will be illustrated by Table I relating to six chemical compounds whose molecular masses M are within 140 daltons. These chemical compounds are respectively:

sarin, of formula $C_4H_{10}O_2FP$,
isobutylthiophene of formula $C_8H_{12}S$,
2,2-dideuterospiro (4,4)nonane-1-one of formula $C_9H_{12}D_2O$,
5-allyl-2-thiolactone,
N-trimethylsilylpyrazole of formula $C_6H_{12}N_2Si$, and
3-terbutylthiophene of formula $C_8H_{12}S$.

For each of these compounds are given on the horizontal lines the molecular masses expressed in daltons of the main secondary dissociation ions (e.g. for sarin the masses 99, 125, 81, 43 and 41) with their extraction voltages $V'/x^2$ expressed in volts.

A mere glance at the table reveals that it is very easy to identify the different masses $m_i$ and that no confusion can exist between them. For each of the substances of mass M, it is the nature and mass $m_i$ of the dissociation products which will enable the detection system automatic control computer to affirm, by reference to the information stored in the apparatus, that the decomposition products of mass $m_1$ which are found correspond to the sought substances of mass $M_i$. This example also reveals how the detection process according to the invention makes it possible to separate without any possible ambiguity the four investigated substances although they all have a molecular mass very close to 140 daltons.

Finally, table II gives two examples 12 and 13 relative to the detection in air of two other toxic gases, namely tabun of mass 162 daltons and soman of mass 182 daltons. Their respective formulas are $C_5H_{11}N_2O_2P$ and $C_7H_5O_2FP$. The table indicates for each of them the reference voltage V' corresponding to the molecular mass M of the subtance and the different extraction voltages of the secondary ions, whose masses $m_i$ are given as 43.70, 44,133 and 106 for tabun and 126.99, 82.109 and 41 L for soman.

Here again, a glance at the table reveals that the different secondary ions $m_i$ are extracted under sufficiently differing voltages to ensure that there is no doubt as regards to their identification and therefore the identification of the primary ion of mass $M_i$ which has given rise to them.

On referring to FIGS. 2 and 3, an example will be given of the automatic performance, under the control of a software-equipped computer, of the process according to the invention. This example involves the permanent monitoring of the atmosphere by detecting in it the presence of one or more known compounds, e.g. toxic compounds, whereof the molecular masses $M_i$ and, for each of them, the possible dissociation products of masses $m_{i1}, m_{i2} \ldots m_{iq}$ are known. All the above information is fed into a memory and is available to the computer.

FIG. 2 is a diagram of the investigation sequences of the compound of mass $M_p$. It is possible to see the computer 10 connected to its software 12 and to the memory 14, shown twice in the diagram for ease of understanding reasons. For the detection of the possible presence of the substance of mass $M_p$ in the air, the ion source 1 is supplied by duct 2 with a sample of said air, whereof it ionizes the components and in particular the substance of mass $M_p$.

The computer then triggers the calibration phase, during which use is made of a new reference $V'_p=(VoM_o/M_p)$ for the extraction voltage and $W'_p=eV'_p$ is used for the electrostatic analyser, whereby $V_o$ and $M_o$ are the values of the extraction voltage of the ion source 1 and the mass of the indissociable ion used for regulating the apparatus and fixing the induction B of the magnetic analyser at the value $B_o$ which will then be maintained constant.

The computer then initiates the sequential investigation phase of the dissociation fragments $m_{pq}$ of the ion of mass $M_p$ at the exit from the dissociaton box 3. For this purpose and sequentially, the computer acts on the means for setting the extraction voltage V and the electrostatic filtration energy W by fixing, during each sequence, said quantities at the values $V_{pq}=(V'_p/x_{pq}^2)$ and $W_{pq}=(W'_p/x_{pq})$ with $x_{pq}=(m_{pq}/M_p)$.

At the end of each sequence, in conjunction with memory 14, computer 10 establishs the absence or presence of the fragment $m_{pq}$ and at the end of the investigation of all the sequences, the absence or presence of the substance of mass $M_p$. The process then involves the repeat of the same stages for the ion of mass $m_{p+1}$ up to the exhaustion of the $M_i$ investigated substances and then a new general cycle can commence.

FIG. 3 shows the overall diagrams of the automatic investigation operations in connection with the substances $M_i$ to be detected, each of the dotted line rectangles being identical to FIG. 2 and relate to the operations of investigating an ion of mass M, namely successively $M_1, M_2 \ldots M_i$. FIG. 3 is self-explanatory on the basis of the above information.

TABLE I

| Ex. No. | Investigated substance M | Fragment m daltons | V Extraction | Fragment m daltons | V Extraction | Fragment m daltons | V Extraction | Fragment m daltons | V Extraction | Fragment m daltons | V Extraction |
|---|---|---|---|---|---|---|---|---|---|---|---|
| 6 | $C_4H_{10}O_2FP$ | 99 | 11.665.9 | 125 | 1254.4 | 81 | 2987.4 | 43 | 10600.3 | 41 | 11665.9 |
| | 2-isobutyl-thiophene $C_8H_{12}S$ | 97 | 2083.1 | 98 | 2040.8 | 45 | 9679.0 | 39 | 12886.2 | 41 | 1999.8 |
| 8 | 2,2-dideutero-spiro(4,4)-nonane-1-one $C_9H_{12}D_2O$ | 99 | 1999.8 | 67 | 2089.6 | 94 | 2218.2 | 82 | 2914.9 | 41 | 11665.0 |
| 9 | 5-allyl-2-thiolactone | 99 | 1999.8 | 71 | 3888.1 | 55 | 2545.5 | 112 | 1562.50 | 45 | 9679.0 |
| 10 | N—trimethyl-silylpyrazole $C_6H_{12}N_2Si$ | 125 | 1254.4 | 98 | 2040.8 | 43 | 10500.3 | 125 | 1234.6 | 45 | 9679.0 |
| 11 | 3-tert-butyl-thiopene $C_8H_{12}S$ | 125 | 1254.4 | 42 | 11665.9 | 39 | 12886.2 | 97 | 2083.1 | 45 | 9679.0 |

TABLE II

| Ex. No. | Investigated substance M | Fragment m daltons | V Extraction | Fragment m daltons | V Extraction | Fragment m daltons | V Extraction | Fragment m daltons | V Extraction | Fragment m daltons | V Extraction |
|---|---|---|---|---|---|---|---|---|---|---|---|
| 12 | tabun M = 162 $C_5H_{11}N_2O_2P$ V′ = 864.2 V | 43 | 12265.6 | 70 | 4628.6 | 44 | 11774.2 | 133 | 12979.4 | 106 | 1282.1 |
| 13 | soman M = 182 $C_7H_5O_2FP$ V′ = 769.2 V | 126 | 1604.9 | 99 | 2599.8 | 82 | 3789.4 | 109 | 5351.8 | 41 | 14444.6 |

I claim:

1. Process for the detection of a chemical substance of known mass M with the aid of an ionization, dissociation, filtration and detection apparatus having in a vacuum enclosure and in the indicated order on the trajectory of the ions:

an ion source (1) producing ions of the substance of mass M and unit charge e under an extraction voltage $V_1$ from a gaseous atmosphere to be analysed, a dissociation box (3) raised to a potential $V_2$ according to the mass M filled with a neutral gas in which the ions of the substance of mass M are dissociated by impacts on the molecules of the neutral gas into different fragments of known masses $m_1, m_2 \ldots m_p$, characteristic of the substance of mass M to be identified, an electrostatic analyser (4) filtering the ions of energy level W, said energy level W being regulatable, a magnetic analyser (5) operating with an induction $B_o$ in its air gap, a detector (6) of the ions which have already passed through the aforementioned apparatus. characterized in that:

the first step is to fix the value of the induction $B_o$ in the air gap of the magnetic analyser by choosing for V and W values $V_o$, $W_o$ such that an indissociable atom of mass $M_o$ passes through the entire apparatus and is detected by the ion detector, such that $$B_o \simeq \frac{144\sqrt{eV_oM_o}}{R} \text{ and } W_o = eV_o$$

in which R is the radius of curvature of the trajectory of the ion in the magnetic analyser are satisfied, to then investigate the presence in the atmosphere to be analysed of the known substance of mass M, which is dissociated into known fragments of masses $m_1=x_1M$, $m_2=x_2M$, . . . $m_p=x_pM$, the apparatus being calibrated for the specific investigation of the mass M by giving to $V_o$ and $W_o$ new values V' and W' such that $V'M=V_oM_o$ and $W'=eV'$, followed by the sequential investigation of the different fragments $m_p$, whilst forming on each occasion $V_p=(V'/x_p^2)$ and $W_p=(W'/x_p)$, which makes it possible for the ion of mass $m_p$ to pass through the entire apparatus and to be revealed by the ion detector and the effective presence of the substance of mass M in the supply gas of the ion source is deduced by the presence of an adequate number, in practice three or four, of dissociation fragments of mass $m_p$ characteristic of the dissociation of the substance of mass M.

2. Process according to claim 1 in which the chemical substance is a series of chemical substances in the atmosphere of masses $M_i$, each having dissociation fragments of known masses $m_{i1}, m_{i2} \ldots m_{ip}$, characterized in that said detection is rendered automatic by placing in a memory the different values of the sought masses $M_i$, as well as for each of them, the different masses $M_{i1}, \ldots m_{ip}$ of their possible dissociation fragments and that a sequential investigation is carried out by a computer equipped with a program controlling the different stages of the process, such that the presence or absence of each of the substances of mass $M_i$ is determined.

3. Process according to claim 2, characterized in that, under the control of a computer, it involves consecutive stages of investigating on each occasion one of the substances of mass $M_p$, each stage of such an investigation involving:

(a) a calibration of the apparatus to define the values $V'_p$ and $W'_p$, such that $V'_pM_p=V_oM_o$ and $W'_p=eV'_p$, (b) a sequential investigation of the dissociation fragments $m_{pq}$ of the ion $M_p$ at the exit from the dissociation box, the computer controlling for each sought fragment $m_{pq}$ the setting of the magnitudes V and W at the values $V_{pq}=(V'_p/x_{pq}^2$ and $W_{pq}=(W'_p/x_{pq})$, with $x_{pq}=(m_q/M_p)$.

* * * * *